United States Patent [19]

Kushida

[11] Patent Number: 4,640,625

[45] Date of Patent: Feb. 3, 1987

[54] EXTERNAL MEMBER FOR A WATCH

[75] Inventor: Hachiro Kushida, Tanashi, Japan

[73] Assignee: Citizen Watch Co., Ltd., Tokyo, Japan

[21] Appl. No.: 834,354

[22] Filed: Feb. 28, 1986

[30] Foreign Application Priority Data

Mar. 1, 1985 [JP] Japan ..... 60-40528

[51] Int. Cl.[4] ..... G04B 37/00; B22F 1/00

[52] U.S. Cl. ..... 368/280; 75/228; 420/534; 428/620

[58] Field of Search ..... 368/276, 280; 75/228–230, 234, 235; 420/533, 534, 538, 546, 547; 428/620, 621, 622, 628

[56] References Cited

U.S. PATENT DOCUMENTS

| | | | |
|---|---|---|---|
| Re. 29,739 | 8/1978 | Kessler | 204/58 |
| 4,017,337 | 4/1977 | Winter et al. | 148/11.5 A |
| 4,297,136 | 10/1981 | Pickens et al. | 75/235 |

*Primary Examiner*—Vit W. Miska

*Attorney, Agent, or Firm*—Birch, Stewart, Kolasch & Birch

[57] ABSTRACT

A body of an external member is made of an aluminum alloy containing 0.5–2.5% of magnesium by weight, less than 0.01% of silicon by weight, and less than 0.01% of iron by weight. An anodic oxide film is formed on the body.

4 Claims, 5 Drawing Figures

EXTERNAL MEMBER FOR A WATCH

BACKGROUND OF THE INVENTION

The present invention relates to an external member for watches, which is made of anodically oxidized aluminum alloys.

A typical conventional aluminum alloy which is used for making an external member, such as a watchcase and band, contains 0.5 to 3% of magnesium (Mg) by weight, and further contains 0.01 to 0.3% of iron (Fe) by weight and 0.1 to 0.2% of silicon (Si) by weight as impurities.

In anodic oxide film formed on such a conventional aluminum alloy as the result of anodic oxidation, impurities in the alloy, especially Fe and Si, are apt to remain therein as fine grained oxides and/or voids are formed caused by partial elution of these elements during anodic oxidation treatment.

FIG. 3 shows a schematic enlarged sectional view of an aluminum alloy watchcase wherein aluminum alloy body 3a for a watchcase is coated with an anodic oxide film 3b. Voids 3c by the elution and remained oxides 3d of impurities are formed in the anodic oxide film. Due to the voids and oxides, the film 3b assumes colors, or the surface of the film is clouded by the irregular reflection of light. In order to eliminate such a defect, the surface of the film is subject to surface smoothing processes such as polishing by buffing and chemical polishing. However, enough brightness can not be obtained. Accordingly, even if the film is dyed with dye such as golden dye, the luster thereof is far inferior to gold plating. This is caused by the color of the anode oxide film or the cloud of the film.

SUMMARY OF THE INVENTION

The object of the present invention is to eliminate the above described defects and to provide an external member of a watch made of anodically oxidized aluminum alloys having brilliance and light tone.

Metalurgical studies have conducted and proved that brightness of alloy is dependent on the amount of impurities, especially Fe and Si. Therefore, the above described problem is solved by employing aluminum having high purity.

It is preferable that, in order to prevent the reduction of brightness of a dye film, the compositions of silicon and iron are less than 0.01%. In order to increase the hardness and reflectance of aluminum alloy, it is preferable to contain 0.5 to 2.5% of magnesium. The thickness of the anodic oxide film is preferably selected between 10 μm and 25 μm. If the thickness is below 10 μm, the color of dye film is blurred and easily scratched. When the thickness is above 25 μm, the brightness reduces and adhesion of the film decreases, which causes the crack of the film.

According to the present invention, there is provided an external member for a watch comprising a body made of an aluminum alloy containing 0.5–2.5% of magnesium by weight, less than 0.01% of silicon by weight, and less than 0.01% of iron by weight, and an anodic oxide film formed on the body.

In an aspect of the invention, a golden dye film is formed on the anodic oxide film, and the anodic oxide film has a thickness between 10 μm and 25 μm.

These and other objects and features of the present invention will become more apparent from the following description with reference to the accompanying drawings.

DESCRIPTION OF THE PREFERRED EMBODIMENTS

Figure 1:
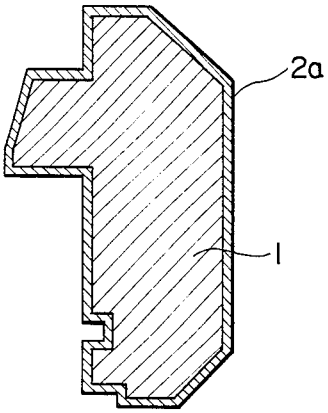
FIG. 1 is a sectional view of a part of a watchcase according to the present invention.
Figure 2:
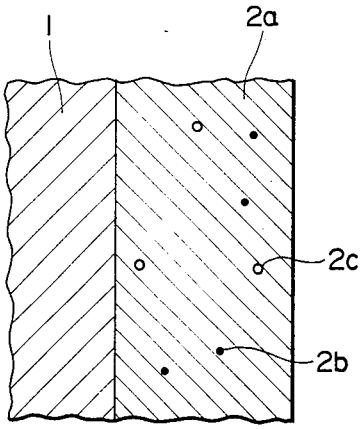
FIG. 2 is an enlarged sectional view of the anodic oxide film of FIG. 1.
Figure 3:
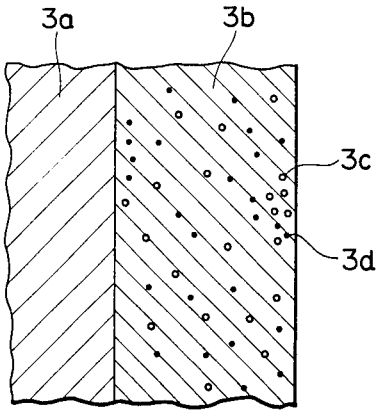
FIG. 3 PRIOR ART
FIG. 3 is an enlarged sectional view of the anodic oxide film according to prior art.

Referring to FIG. 1, a watchcase according to the present invention comprises case body 1 the surface of which is coated with anodic oxide film 2a. The body 1 is made of aluminum alloy containing 1.0% of Mg by weight, 0,005% of Si by weight and 0.004% of Fe by weight. As shown in FIG. 2, the anodic oxide film 2a has oxides 2b of the impurities and voids 2c as results of their elution.

The body 1 is produced in accordance with the following process. The aluminum alloy is reduced 50 percent by cold rolling and further shaped by a friction screw press thereby forming a blank. The blank is subjected to the low temperature annealing at a temperature of 270° C. for refining the grain.

The blank is made into a watchcase in accordance with ordinary watchcase manufacturing processes and surfaces of which are finished by buffing.

The anodic oxidation treatment is carried out in the following steps.

EXAMPLE I

| | |
|---|---|
| 1. Pretreatment I: Chemical polishing | |
| Bath composition: | |
| phosphoric acid | 90% |
| nitric acid | 8% |
| water | 2% |
| Treating temperature: | 105° C. |
| Treating period: | 20 seconds |
| Pretreatment II: Activation | |
| Bath composition: | |
| nitric acid | 30% |
| Treating temperature: | 20° C. |
| Treating period: | 10 seconds |
| 2. Anodic Oxidation Treatment: | |
| Bath composition: | |
| oxalic acid | 15% |
| sulfuric acid | 3% |
| water | remainder |
| Treating temperature: | 20° C. |
| Current density: | 1.5 A/dm$^2$ |
| Treating period: | 50 minutes |
| 3. Dyeing: | |
| Dyestuff: | |
| organic gold dyestuff | 5 g/l |
| Treating temperature: | 50° C. |
| Dipping period: | 2 minutes |
| 4. Sealing: | |
| Bath composition: | pure water |
| Treating temperature: | 95° C. |
| Treating period: | 60 minutes |

The watchcase obtained by the above described processes has a film of 20 to 25 μm and has the same brightness as a gold plated watchcase.

The watchcase according to the EXAMPLE I was compared with conventional watchcases produced by treating a conventional aluminum alloy under the same conditions as the

EXAMPLE I

For a quantitative comparison, a colorimeter (Minolta CR-100) was used to measure the reflectance of the surface of each watchcase. Table 1 shows relative values of reflectance of the watchcase when assuming that the value of reflectance of the watchcase according to the present invention after the chemical polished state before the anode oxidation treatment is 100. As can be seen from Table 1, compared with conventional watchcases, deterioration of brightness of the surface of the watchcase according to the present invention is so small even after the anodization, and the brightness is comparable to that of a gold plated product.

small, the hair lines are formed on the surface without blurring.

If the plating is performed on the case body with hair lines, the lines are blurred by the plating. Accordingly, heretofore, the hair lines are formed in an intermediate stage of the plating process. This working is very difficult, resulting in increase of the cost.

From the foregoing, it will be understood that the present invention provides an external member made of aluminum alloy containing Fe and Si in an amount less than 0.01% in weight so that the member matches a gold plated member in brightness. Accordingly, it makes it possible to provide inexpensive gold colored watch members without employing gold (Au). Furthermore, since the member is coated with hard anodic oxidation film, it has high wear resistance.

While the invention has been described in conjunction with preferred specific embodiments thereof, it will be understood, that this description is intended to illustrate and not limit the scope of the invention, which is defined by the following claims.

TABLE 1

Reflectances (brightness) of watchcases of various alloys

| | SPECIMEN No. | MEMBER | COMPOSITION Fe | Si | Mg | COLOR | REFLECTANCE BEFORE ANODIZATION | REFLECTANCE AFTER ANODIZATION | REFLECTANCE AFTER GOLDEN DYEING |
|---|---|---|---|---|---|---|---|---|---|
| PRESENT INVENTION | 1 | Watchcase | 0.004% | 0.005% | 1.0% | gold | 95 | 90 | 85 |
| | 2 | Watchcase | " | " | " | " | 98 | 91 | 86 |
| | 3 | Watchcase (low temperature annealing) | " | " | " | " | 100 | 91 | 88 |
| | 4 | Band (low temperature annealing) | 0.005 | 0.006 | 2.4 | gold | 95 | 89 | 84 |
| | 5 | Dial | 0.008 | 0.005 | 0.7 | black | 99 | 91 | — |
| | 6 | Watchcase | 0.003 | 0.008 | 1.8 | gold | 98 | 91 | 86 |
| PRIOR ART | 7 | " | 0.25 | 0.13 | 2.5 | " | 90 | 50 | 45 |
| | 8 | " | 0.15 | 0.09 | — | " | 92 | 65 | 60 |
| | 9 | " | 0.03 | 0.04 | 0.8 | " | 95 | 80 | 77 |
| | 10 | 6:4 brass gold-plated watchcase | | — | | " | — | — | 90 |

Note
Specimen Nos. 1, 2 and 7 are buffed and No. 3 is chemically polished.

The invention is applied to a watchcase in the present embodiment but may also be applied to other external watch members such as dials, supporting rings, bands, back of watchcases, crowns and pushbuttons.

Additionally, dyestuff maybe of other bright colors besides gold so as to provide fashionable watches.

EXAMPLE II

Figure 4:
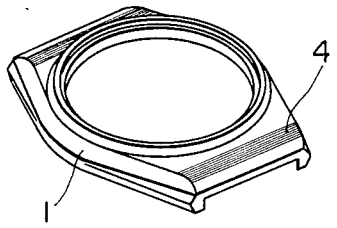
FIG. 4 is a perspective view showing a watchcase made by the present invention.
Figure 5:
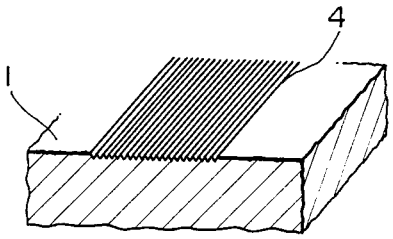
FIG. 5 is a sectional perspective view showing a part of the watchcase of FIG. 4.

Composition of aluminum alloy and processes before anodic oxidation treatment are the same as the EXAMPLE I. After the finishing of the surface of the blank, the hairline finish process is performed by a sandpaper of 400 mesh to form hair lines comprising a plurality of parallel scratches. FIGS. 4 and 5 show the hair lines 4 formed on the case body 1. After that the processes in the EXAMPLE I from the step 2 to 4 are performed. Since the thickness of the golden film dyeing is very

What is claimed is:

1. An external member for a watch comprising:

a body made of an aluminum alloy containing 0.5–2.5% of magnesium by weight, less than 0.01% of silicon by weight, and less than 0.01% of iron by weight; and an anodic oxide film formed on the body.

2. The external member according to claim 1 further comprising a golden dye film formed on the anodic oxide film.

3. The external member according to claim 1 wherein the anodic oxide film has a thickness between 10 μm and 25 μm.

4. The external member according to claim 1 wherein the body has hair lines.

* * * * *